United States Patent [19]

Groeneveld et al.

[11] Patent Number: 4,967,140

[45] Date of Patent: Oct. 30, 1990

[54] CURRENT-SOURCE ARRANGEMENT

[75] Inventors: Dirk W. J. Groeneveld; Hendrikus J. Schouwenaars, both of Eindhoven, Netherlands

[73] Assignee: U.S. Philips Corporation, New York, N.Y.

[21] Appl. No.: 380,163

[22] Filed: Jul. 14, 1989

[30] Foreign Application Priority Data

Sep. 12, 1988 [NL] Netherlands ..... 8802230
Jan. 30, 1989 [NL] Netherlands ..... 8900215

[51] Int. Cl.[5] ..... G05F 1/56
[52] U.S. Cl. ..... 323/315; 323/317
[58] Field of Search ..... 323/311, 315, 316, 317

[56] References Cited

U.S. PATENT DOCUMENTS 4,327,320 4/1982 Oguey et al. ..... 323/316
4,346,344 8/1982 Blauschild ..... 323/316
4,408,190 10/1983 Nagano ..... 323/315
4,542,332 9/1985 van de Plassche ..... 323/317
4,573,005 2/1986 van de Plassche ..... 323/315
4,587,477 5/1986 Hornak et al. ..... 323/317
4,864,215 9/1989 Schouwenaars et al. ..... 323/317

*Primary Examiner*—Peter S. Wong
*Attorney, Agent, or Firm*—Bernard Franzblau

[57] ABSTRACT

A current source arrangement in which N configurations of N+1 transistor configurations (2.1 to 2.N+1) comprising control transistors (T1 to T N+1) and control inputs (3.1 to 3.N+1) are connected to N outputs (1, 2, . . . N) by means of a switching network (7) in accordance with a cyclic pattern N. The remaining configuration is connected to a correction circuit (5) which includes a reference-current-source (6) for adjusting the control voltage of the control transistor via the control input of the relevant transistor configuration, in such a way that the output current of the relevant configuration becomes equal to that of the reference-current-source.

22 Claims, 4 Drawing Sheets

CURRENT-SOURCE ARRANGEMENT

BACKGROUND OF THE INVENTION

The present invention relates to a current-source arrangement comprising:

a plurality of transistor configurations for generating a plurality of substantially equal currents, and correction means for reducing the mutual deviation in the currents from the transistor configurations.

The invention also relates to a digital-to-analog converter comprising such an arrangement.

Such an arrangement is know from U.S. Pat. No. 4,573,005. In this arrangement the correction means comprise a precision-current-mirror circuit in which the current from one transistor configuration is applied to the input as a reference-current and the current from another transistor configuration is applied to the at least one output in accordance with a cyclic pattern. The difference between the reference-current and the current from the other transistor configuration then appears on this output, said difference being used to correct the last mentioned current in such a way that it is in better compliance with the reference-current.

A disadvantage of this arrangement is that the precision-current-mirror circuit must be arranged in series with the transistor configuration and its load so that the known current-source arrangement requires a comparatively high supply voltage.

SUMMARY OF THE INVENTION

Therefore, it is an object of the invention to provide a current-source arrangement with correction means and which is constructed to operate on comparatively low supply voltages.

In accordance with the invention a current-source arrangement of the type defined in the opening paragraph is characterized in that:

the number of transistor configurations is at least one larger than the required number of currents, each transistor configuration comprises a control transistor whose control voltage is adjustable to supply an adjustable first current, and the correction means are adapted to make the current from each transistor configuration equal to a reference-current in accordance with a cyclic pattern by adjusting the control voltage of the control transistor of the relevant transistor configuration.

Since, in the arrangement in accordance with the invention, the number of transistor configurations is one larger than actually required, this means that in every cycle period it is possible to use one transistor configuration of the current-source arrangement for the purpose of correction and to switch the transistor configuration corrected in the preceding cycle period back into the current-source arrangement. Since, during correction, a transistor configuration is no longer connected in series with the load of the current-source arrangement, the arrangement can be operated with comparatively low supply voltages.

Another advantage of the current-source arrangement in accordance with the invention is that the operation of the actual current-source arrangement is not disturbed by the correction means.

Embodiments of a current-source arrangement according to the invention are defined in the appended dependent claims.

BRIEF DESCRIPTION OF THE DRAWINGS

The invention will now be described in more detail, by way of example, with reference to the accompanying drawings in which.

DESCRIPTION OF THE PREFERRED EMBODIMENTS

Figure 1:
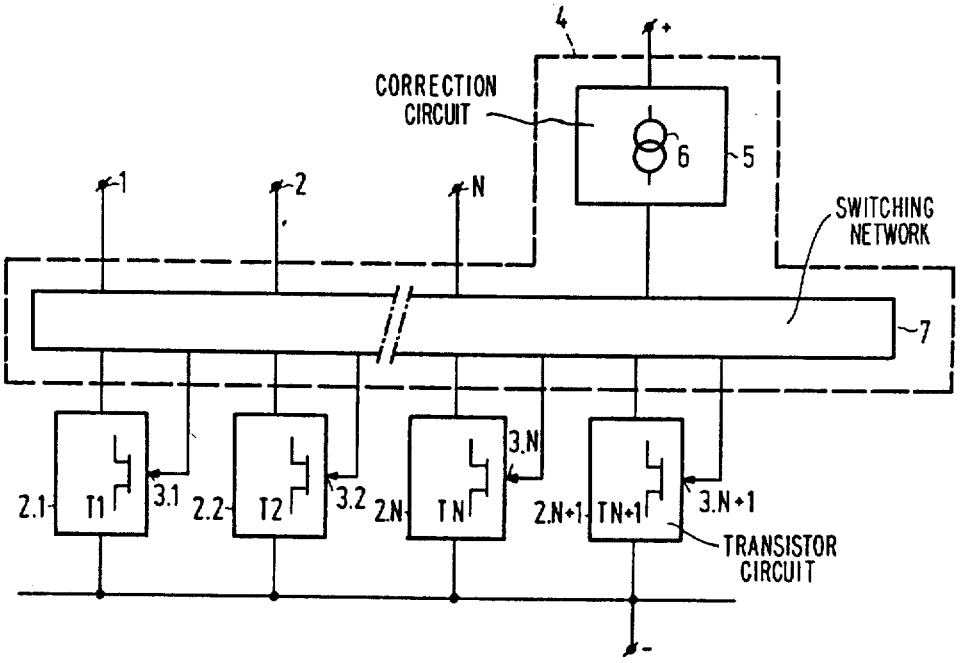
FIG. 1 shows the basic circuit diagram of a current-source arrangement in accordance with the invention.

FIG. 1 is a basic diagram of a current-source arrangement in accordance with the invention. The arrangement is constructed to supply N substantially equal currents to outputs 1 to N, to which loads, which are not shown for the sake of simplicity, can be connected. The arrangement comprises N+1 transistor configurations 2.1 to N+1 with respective control transistors T1 to T.N+1. The transistor configurations further comprise control inputs 3.1 to 3.N+1 for adjusting the control voltages and hence the currents of the control transistors T.1 to T.N+1. The arrangement further comprises correction means 4 comprising a correction circuit 5 having a reference-current-source 6 for supplying the control signal to one of the control inputs 3.1 to 3.N+1, and having a switching network 7 for coupling each time one of the transistor configurations 2.1 to 2.N+1 to the correction circuit 5 and for coupling the other transistor configurations to the outputs 1 . . . N in accordance with a cyclic pattern.

In the present arrangement N transistor configurations supply the output currents to the outputs 1 to N in every period of a cycle, the remaining transistor configuration being coupled to the correction circuit 4. In this circuit the current from the relevant transistor configuration is compared with the reference-current from the source 6 and, by means of a control signal applied to the control input 3 of the relevant transistor configuration by the correction circuit 5, the control voltage of the relevant control transistor 2 is adjusted in such a way that the current from the transistor configuration is equal to the reference-current. In the next period of the cycle the corrected transistor configuration 2 is exchanged with an uncorrected transistor configuration 2 by means of the switching network 7. Thus, the current from all the transistor configurations 2.1 to 2.N+1 are corrected successively and continually. As a result of this, the currents available at the outputs 1 to N are substantially equal to the reference-current. Since a transistor configuration to be corrected is switched out of the actual current-source arrangement the correction circuit 5 will not disturb the correct operation of the current-source arrangement. Since the correction circuit does not require a higher supply voltage than during normal operation of the arrangement, the current-source arrangement is suitable for operation with low supply voltages.

Figure 2:
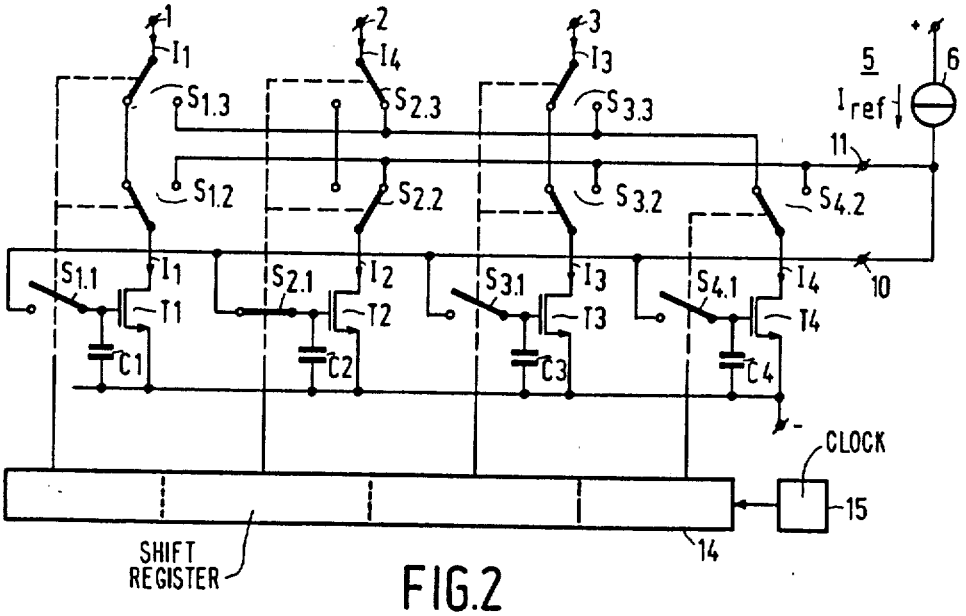
FIG. 2 shows a first embodiment of a current-source arrangement in accordance with the invention.

FIG. 2 shows a first embodiment of a current-source arrangement in accordance with the invention. The arrangement comprises four transistor configurations comprising control transistors T1 to T4 with capacitors C1 to C4 arranged between their gate and source electrodes. By means of switches S1.1 to S4.1, S1.2 to S4.2 and S1.3 to S3.3 each time three of the four transistors T1 to T4 can be coupled to the outputs 1, 2 and 3, the remaining transistor being coupled to the inputs 10 and 11 of the correction circuit 5. These switches are controlled in accordance with a cyclic pattern, in the present example by means of a shift register 14 which is controlled by a clock 15.

The Figure illustrates the situation in which the currents I1, I3 and I4 from the transistors T1, T3 and T4 are applied to the outputs 1, 2 and 3, while the current I2 from the transistor T2 is applied to the input 11 of the correction circuit 5. The switches S1.1, S3.1 and S4.1 are open and the switch S2.1 is closed so that the gate electrode of the transistor T2 is coupled to the input 10. In the present example the correction circuit comprises a reference-current-source 6, which supplies a current Iref to the interconnected inputs 10 and 11.

As a result of this direct connection between the inputs 10 and 11 the drain electrode of the transistor T2 is connected to its gate electrode. The current-source 6 now controls the voltage on the capaciter C2 in such a way that the current I2 becomes accurately equal to the reference-current Iref. In the next clock period the transistor T2 is connected to the output 2 by means of the switches S2.2 and S2.3, and at the same the switch S2.1 is opened. The voltage on the capacitor C2 therefore remains available to control the transistor T2 so that it continues to supply a current I2 which is accurately equal the current Iref. In the same clock period one of the other three transistors, for example, the transistor T3, is connected to the inputs 10 and 11 of the correction circuit and the control voltage on the capacitor C3 is adjusted in such a way that the current I3 becomes accurately equal to the current Iref. Thus, the currents I1 to I4 of the transistors T1 to T4 are successively and continually made equal to the current Iref. This results in accurately equal currents being available on the outputs 1, 2 and 3.

Figure 3:
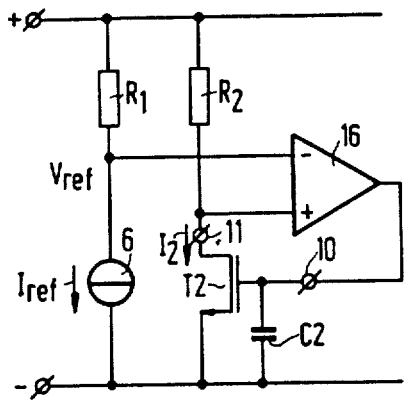
FIG. 3 shows a second embodiment of a current-source arrangement in accordance with the invention.

FIG. 3 shows a second embodiment of a current-source arrangement in accordance with the invention, in which for simplicity only the correction circuit and the transistor to be corrected are shown. The correction circuit comprises a current-source 6, which supplies a reference-current Iref, which is converted into a reference voltage Vref across a resistor R1. The input 11 is connected to the positive power-supply terminal via a resistor R2. The resistors R1 and R2 are connected to the inverting input and the non-inverting input of an amplifier 16, whose output is connected to the input 10. Again the gate and the drain electrode of the transistor T2 are connected to the inputs 10 and 11. The current I2 from the transistor T2 is converted into a proportional voltage across the resistor R2. The amplifier 16 now controls the voltage across the capacitor C2 in such a way that the voltage across the resistor R2 is equal to the reference voltage Vref across the resistor R1. When R1 and R2 have equal resistance values the current I2 will be accurately equal to the current Iref. By selecting a specific ratio for the resistance values of the resistors R1 and R2 it is possible to define the ratio between the currents Iref. and I2.

Figure 4:
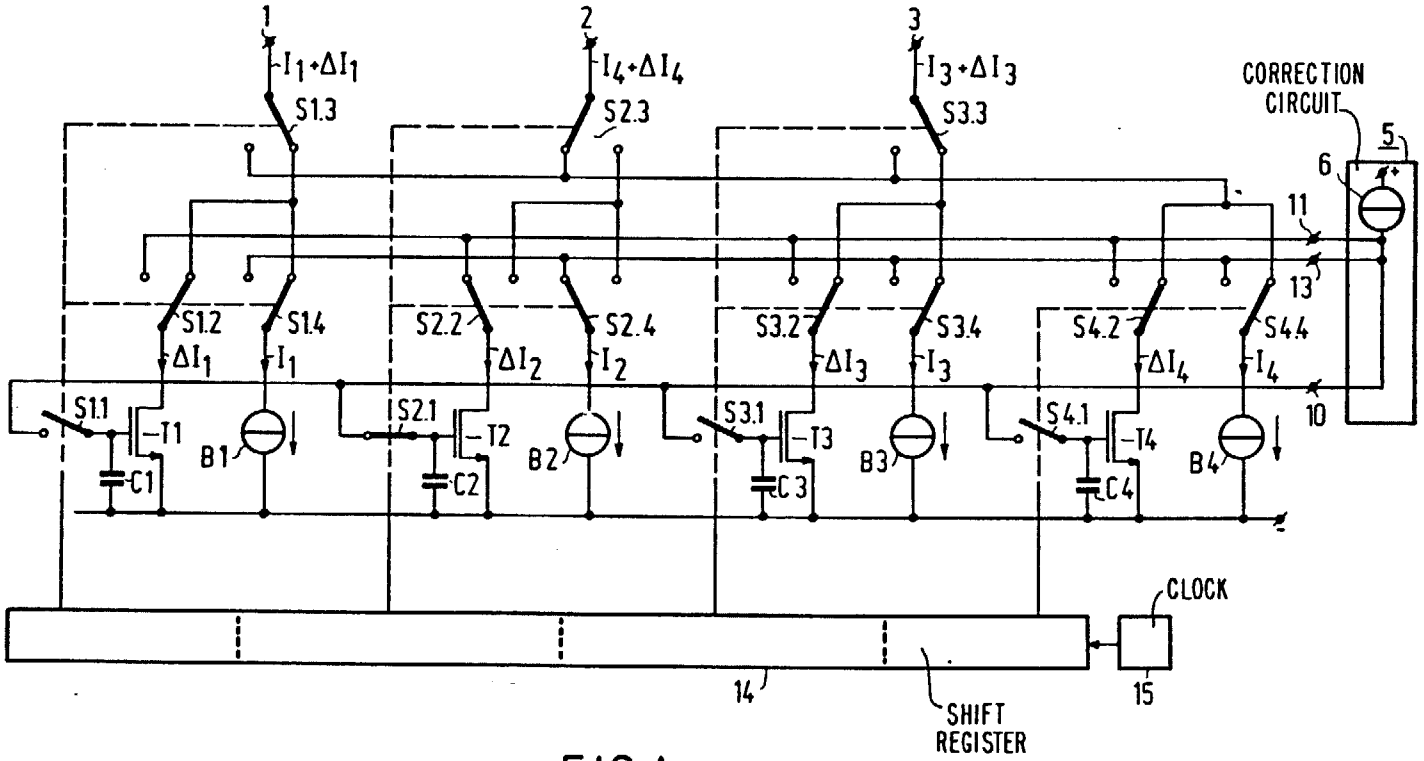
FIG. 4 shows a third embodiment of a current-source arrangement in accordance with the invention.

FIG. 4 shows a third embodiment of a current-source arrangement in accordance with the invention in which identical parts bear the same reference numerals as in FIG. 2. The transistor configurations now comprise control transistors T1 to T4 and capicitors C1 to C4, with which current-sources B1 to B4 are arranged in parallel. The current supplied by a transistor configuration is equal to the sum of the currents from a control transistor and its current-source. The currents from the current sources B1 to B4 are therefore smaller than the reference current from the current source 6. By means of switches S1.1 to S4.1, S1.2 to S4.2, S1.4 to S4.4, and S1.3 to S3.3, each time three of the four currents of the transistor configurations T1, B1 to T4, B4 can be applied to the outputs 1, 2 and 3, while the currents from the control transistor and the current-source of the remaining transistor configuration are applied to inputs 11 and 13 of the correction circuit 5.

The Figure illustrates the situation in which the currents from the transistor configurations T1, B1, T3, B3 and T4, B4 are applied to the outputs 1, 3 and 2 and the transistor configuration T2, B2 is connected to the correction circuit 5. The switches S1.1, S3.1 and S4.1 are then open and the switch S2.1 is connected to the input 10 of the correction circuit 5. The correction circuit 5 again comprises a current-source 6 for supplying a reference-current Iref, which current source has its output connected to the inputs 10, 11 and 13.

The difference ΔI2 between the currents Iref and I2 is applied to the drain electrode of the transistor T2. The current-source 6 now controls the voltage on the capacitor C2 in such a way that the sum of the currents I2 and ΔI2 is equal to the current Iref. For the remainder the arrangement operates in the same way as that shown in FIG. 2. Since the correction circuit only corrects a small difference current via the voltage on the capacitor C2, the susceptibility of the output current to small variations in the gate-source voltage of transistor T2 is reduced substantially.

Figure 5:
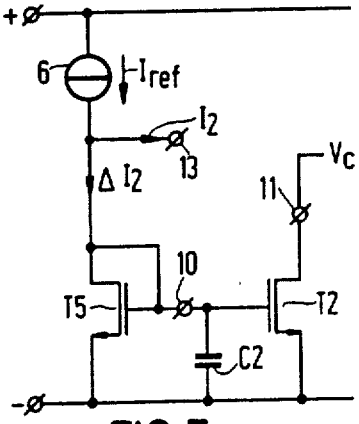
FIG. 5 shows a fourth embodiment of a current-source arrangement in accordance with the invention.

FIG. 5 shows a fourth embodiment in which for simplicity only the correction circuit the transistor to be corrected are shown. Identical parts bear the same reference numerals as in FIG. 4. Again the correction circuit comprises a current-source 6, which carries a reference-current Iref. The current I2 of the current-source B2 is derived from this current at the input 13. The difference between the currents Iref and I2 is applied to a transistor T5, whose drain electrode is connected to the gate electrode. The gate electrode is coupled to the input 10. The input 11 is coupled to a point carrying a direct voltage Vc. Again the gate and the drain electrode of the transistor T2 are connected to the inputs 10 and 11. The transistor T5 in conjunction with the transistor T2 constitutes a current-mirror circuit, to which the current ΔI2 is applied. This current controls the voltage on the capacitor C2 in such a way that the current of the transistor T5 is accurately equal to the current ΔI2. Since the same control voltage appears between the gate and the source electrode of the transistor T2 the current of the transistor T2 will also be accurately equal to ΔI2. For the remainder the arrangement operates in the same way as that in FIG. 4.

Figure 6:
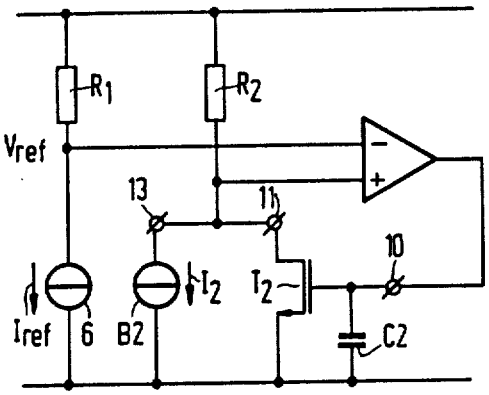
FIG. 6 shows a fifth embodiment of a current-source arrangement in accordance with the invention.

FIG. 6 shows a fifth embodiment in which only the correction circuit and the transistor to be corrected are shown. Identical parts bear the same reference numerals as in FIG. 3. The arrangement operates in the same way as that shown in FIG. 3, the difference being that now the sum of the current ΔI2 from the transistor T2 and the current I2 from the current-source B2 is applied to the resistor R2.

Figure 7:
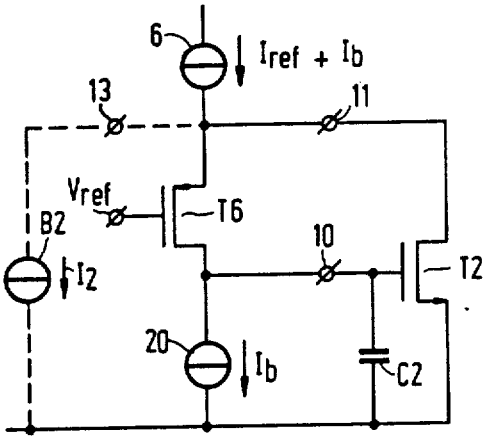
FIG. 7 shows a sixth embodiment of a current-source arrangement in accordance with the invention, FIGS. 8*a* and 8*b* two examples of switches for use in a current-source arrangement in accordance with the invention.

FIG. 7 shows a sixth embodiment and again shows only the correction circuit and the transistor to be corrected. Identical parts bear the same reference numerals as in FIG. 2. Again the correction circuit comprises a current-source 6, which now supplies a current Iref +Ib, and a transistor T6 whose source electrode is coupled to the current-source. 6, whose gate electrode is at a voltage Vref, and whose drain electrode is connected to the negative power-supply terminal via a bias-current-source 20 which carries a current Ib. Again the gate and the drain electrode of the transistor T2 are connected to the inputs 10 and 11 of the correction circuit. The difference current Iref between the currents from the current-sources 6 and 20 again controls the voltage on the capacitor C2, via the transistor T6, such that the current I2 from the transistor T2 becomes accurately equal to the current Iref. The reference voltage Vref is selected in such a way that the voltage on the drain electrode of the transistor T2 is equal to the drain voltage of the transistor T2 when this transistor is switched into the actual current-source arrangement or D/A converter. This is to ensure that as a result of another drain-source voltage the transistor T2 in the actual arrangement cannot carry another current than in the correction circuit.

It will be evident that this correction circuit may also be employed in the embodiment shown in FIG. 4, in which case the current-source B2 should again be connected to the input 13 of the correction circuit, as is shown in broken lines in FIG. 7. The difference current ΔI2=Iref−I2 then controls the voltage across the capacitor C2 via the transistor T6 in such a way that the current through the transistor T2 becomes accurately equal to the current ΔI2.

Figure 8A:
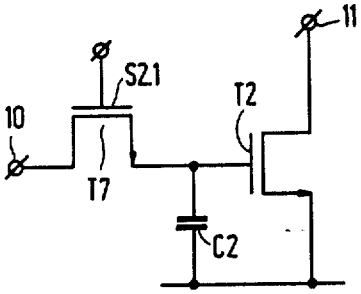
Figure 8B:
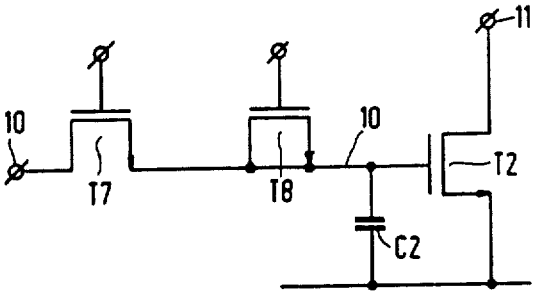

In the embodiments shown the switches suitably comprise transistors. By way of illustration FIG. 8*a* shows a transistor T2 with a capacitor C2 and a switch S2.1 comprising a transistor T7. FIG. 8*b* shows a modification to this where a transistor T8 is arranged in series with the transistor T7 and has its drain connected to the source electrode. A signal which is the inverse of the signal applied to the gate of the transistor T7 is applied to the gate of the transistor T8. Transistor T8 thereby prevents the charge present in the transistor T7 from being drained to the capacitor C2 during turn off.

The capacitors C1 to C4 in the embodiment shown herein may be separate capacitors but may also be constituted in a suitable manner by the gate-source capacitances of the transistors.

Figure 9:
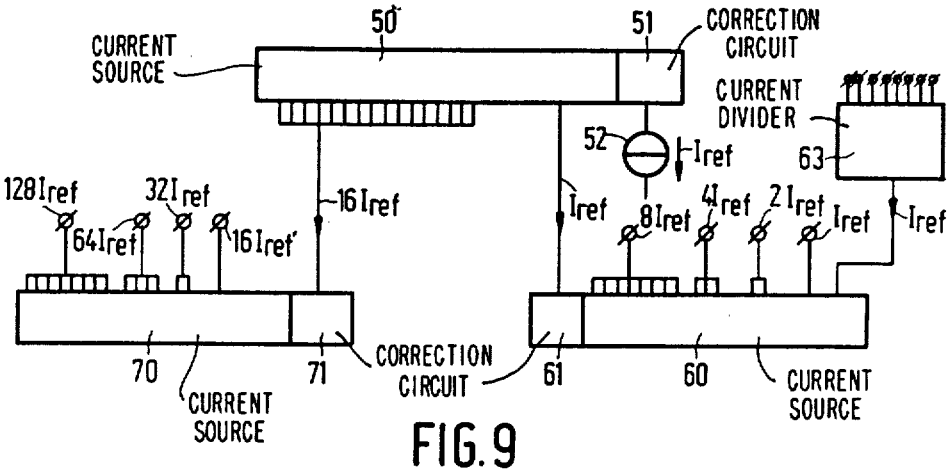
FIG. 9 shows a first embodiment of a digital-to-analog converter comprising current-source arrangements in accordance with the invention.

FIG. 9 shows a first embodiment of a D/A converter comprising current-source arrangements in accordance with the invention. The present example is a 16-bit D/A converter. It comprises a current-source arrangement 50, shown diagrammatically, comprising 18 transistor configurations whose currents are made substantially equal to the reference-current Iref from a current-source 52 by means of a correction circuit 51 in a manner as described above. One current Iref of the seventeen output currents is employed as the reference-current for the correction circuit 61 of a second current-source arrangement 60 comprising seventeen transistor configurations, whose currents are made equal to the current Iref in a manner as described above. One of the currents Iref in the arrangement 60 is applied to a binary current divider 63 which in the present example supplies the currents for the eight least significant bits. The other currents of the arrangement are combined so as to obtain a binary-weighted series of currents Iref, 2Iref . . . 8Iref. The sixteen other currents in the current-source arrangement 50 are combined to obtain a current 16Iref, which is applied as a reference-current to the correction circuit 71 of a third current-source arrangement 70 comprising sixteen transistor configurations, whose currents are made equal to the current 16Iref in a manner as described above. The fifteen currents in the current-source arrangement 70 are combined so as to obtain the binary-weighted series 16Iref, 32Iref . . . 128Iref. The output currents of the current-source arrangements 60 and 70 and the current divider 63 are used in known manner to convert a digital input code into an analog output signal.

Figure 10:
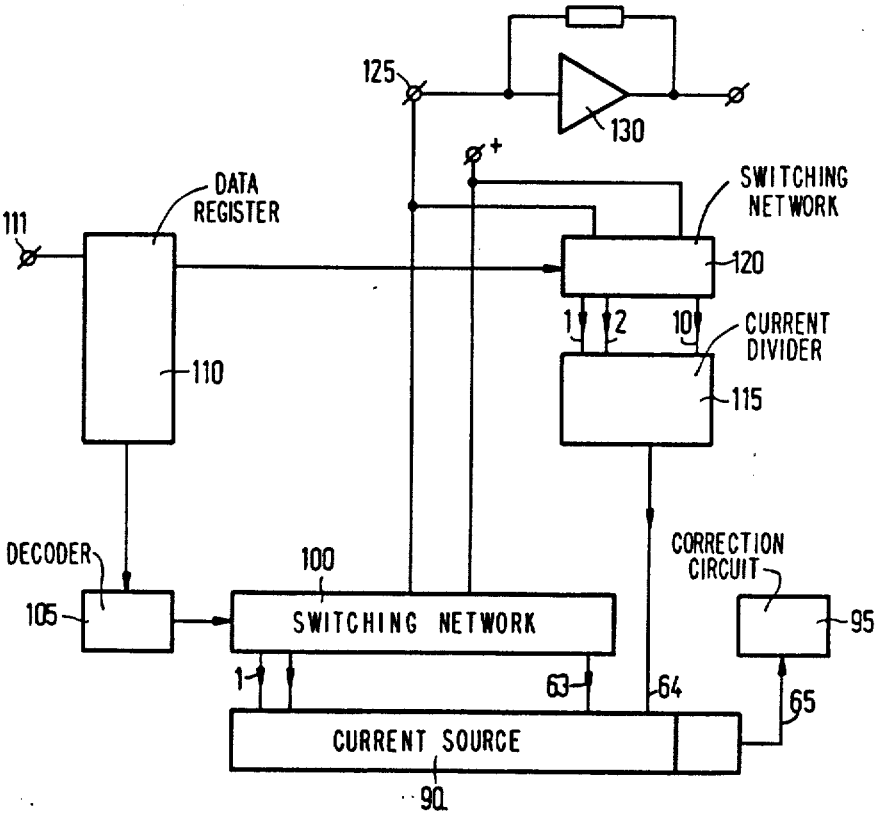
FIG. 10 shows a second embodiment of a digital-to-analog converter in accordance with the invention.

FIG. 10 shows a second embodiment of a 16-bit D/A converter comprising a current-source arrangement in accordance with the invention. It comprises a current-source 90, shown diagrammatically, for generating 64 substantially equal currents which are succesively and continually made equal to a reference-current by means of a correction circuit 95 in a manner as described above. By means of a switching network 100, comprising 63 two-way switches, which are not shown for simplicity, 63 currents are applied either to the summing point 125 or to a positive power-supply terminal depending on the 6 most significant bits of the digital input code. One of the 64 currents is applied to the current-dividing circuit 115, which is shown diagrammatically. The current-dividing circuit 115 supplies the currents for the 10 least significant bits, which currents, by means of a switching network 120 comprising two-way switches which are not shown for simplicity, are applied either to the summing point 125 or to the positive power-supply terminal depending on the digital input code. The total output current Iout appearing on the summing point 125 can be converted into an output voltage Vout by means of a current-voltage converter 130, shown diagrammatically.

In the present embodiment the 16-bit digital input word is applied serially to an input 111 of a data register 110. The 10 least significant bits directly control the switches of the switching network 120. The 6 most significant bits are first applied to a decoding device 105, which derives the switching signals for the 63 switches of the switching network 100 from these bits.

In the D/A converters comprising current-source arrangements in accordance with the invention, the frequency with which the correction network is connected to the successive transistor configurations is preferably selected in such a way that the frequency at which the digital input code is applied is equal to a multiple ($N \geqq 1$) of said switching frequency. This results in switching transients, which may be caused by the correction and switching network, being smoothed by the customary deglitching network arranged at the output of a D/A converter in order to smooth switching transients produced by the actual D/A converter.

The invention is not limited to the embodiments disclosed herein. For example, the correction circuit may also be constructed in other ways than are shown herein.

We claim:

1. A current-source arrangement for supplying a required number of currents comprising:

a plurality of transistor circuit configurations for generating a plurality of substantially equal currents, and correction means for reducing any mutual deviation in the currents from the transistor circuit configurations, characterized in that the number of transistor circuit configurations is at least one larger than the required number of currents, each transistor circuit configuration comprises a control transistor whose control voltage is adjustable to supply an adjustable first current, and the correction means are adapted to make the current from each transistor circuit configuration equal to a reference-current in accordance with a cyclic pattern by adjusting the control voltage of the control transistor of each said transistor circuit configuration.

2. A current-source arrangement as claimed in claim 1, wherein each transistor configuration comprises the control transistor with a capacitor connected between its gate and its source electrode.

3. A current-source arrangement as claimed in claim 2, wherein the capacitor comprises the gate-source capacitance of a control transistor.

4. A current-source arrangement as claimed in claim 2, wherein the correction means comprise means for applying a reference-current to the drain electrode of the control transistor and negative-feedback means coupled between the drain and the gate electrode for controlling the voltage on the capacitor in such a way that the first current is equal to the reference-current.

5. A current-source arrangement as claimed in claim 4, wherein the capacitor comprises the gate-source capacitance of a control transistor.

6. A current-source arrangement as claimed in claim 4, wherein the negative-feedback means comprise adjustment means for adjusting the voltage on the drain electrode of the control transistor.

7. A current-source arrangement as claimed in claim 6, wherein the adjustment means comprise a current-follower transistor whose source electrode is coupled to the drain electrode of the control transistor, whose gate electrode is coupled to a reference voltage terminal, and whose drain electrode is coupled to a bias-current-source.

8. A current-source arrangement as claimed in claim 2, wherein the correction means comprise:

a first resistor for converting the reference-current into a reference voltage, a second resistor for converting the first current into a second voltage, and negative-feedback means connected to the first and the second resistor and the capacitor for adjusting the voltage on the capacitor in such a way that the second voltage is equal to the reference voltage.

9. A current-source arrangement as claimed in claim 8, wherein the capacitor comprises the gate-source capacitance of a control transistor.

10. A current-source arrangement as claimed in claim 1, wherein each transistor configuration comprises the control transistor with a capacitor connected between its gate and its source electrode, and a transistor current-source for supplying a second current, the current from the transistor configuation being equal to the sum of the first and the second current.

11. A current-source arrangement as claimed in claim 10, wherein the capacitor comprises the gate-source capacitance of the control transistor.

12. A current-source arrangement as claimed in claim 10, wherein the correction means comprise means for applying the difference between the reference-current and the second current to a drain electrode of the control transistor and negative-feedback means coupled between the drain and the gate electrode for adjusting the voltage on the capacitor in such a way that the sum of the first and the second current is equal to the reference-current.

13. A current-source arrangement as claimed in claim 12, wherein the capacitor comprises the gate-source capacitance of a control transistor.

14. A current-source arrangement as claimed in claim 10, wherein the correction means comprise means for supplying the difference between the reference-current and the second current to a drain electrode of a second transistor having its gate-source junction connected in parallel with the gate-source junction of the control transistor, and negative-feedback means coupled between the drain and gate electrode of the second transistor to control the voltage on the capacitor in such a way that the sum of the current from the second transistor and the second current is equal to the reference-current.

15. A current-source arrangement as claimed in claim 14, wherein the negative-feedback means comprise adjustment means for adjusting the voltage on the drain electrode of the control transistor.

16. A current-source arrangement as claimed in claim 15, wherein the adjustment means comprise a current follower transistor, having its source electrode coupled to the drain electrode of the control transistor, its gate electrode coupled to a reference voltage terminal,and its drain electrode coupled to a bias-current-source.

17. A current-source arrangement as claimed in claim 14, wherein the capacitor comprises the gate-source capacitance of a control transistor.

18. A current-source arrangement as claimed in claim 16, wherein the correction means comprise:

a first resistor for converting the reference-current into a reference voltage, a second resistor for converting the sum of the first and the second current into a second voltage, and negative-feedback means connected to the first and the second resistor and the capacitor for adjusting the voltage on the capacitor in such a way that the second voltage is equal to the reference voltage.

19. A current-source arrangement as claimed in claim 18, wherein the capacitor comprises the gate-source capacitance of a control transistor.

20. A digital/analog converter comprising:

an input terminal for a digital signal, an output terminal for summing a plurality of selected currents determined by said digital signal, a data register coupled to said input terminal, a switching network controlled by said data register for selectively coupling a plurality of outputs of a current source arrangement to said output terminal, and wherein said current source arrangement comprises:

a number of outputs coupled to said output terminal for supplying thereto said plurality of selected currents, a plurality of transistor circuits for supplying a required number of substantially equal currents to said number of outputs, wherein the number of transistor circuits is at least one more than the required number of equal currents, each transistor circuit comprising a control transistor whose control voltage is adjustable to adjust the current supplied by the transistor circuit, correction means adapted to adjust the control voltage of a transistor circuit so as to make the current of the transistor circuit equal to a reference current, and a switching circuit for cyclically coupling said correction means to said control transistors for cyclically adjusting said control voltages of the transistor circuits to make the current of each transistor circuit in turn equal to said reference current, said switching circuit further selectively coupling said transistor circuits to said outputs.

21. A current source arrangement comprising:

a number of outputs for supplying a number of currents each substantially equal to a reference current, a plurality of transistor circuits for generating said number of substantially equal currents, wherein the number of transistor circuits is at least one more than said number of outputs and each transistor circuit includes a control transistor whose control voltage is controllable to adjust the current generated, correction means adapted to adjust the control voltage of a transistor circuit so as to make said transistor circuit current equal to a reference current, a switching circuit for selectively coupling said correction means to said transistor circuits and said transistor circuits to said outputs, and means for operating said switching circuit so as to couple said correction means to individual ones of said transistor circuits in a cyclic pattern whereby the control voltages of the transistor circuits are cyclically adjusted to make the current of each transistor circuit equal to said reference current, and to also selectively couple said transistor circuits to said outputs in a cyclic pattern.

22. A current source arrangement as claimed in claim 21, wherein said operating means at an instant of time operates the switching circuit to couple to said outputs all of said transistor circuits but the individual one coupled to the correction means.

* * * * *